US011261579B1

(12) United States Patent
Willis

(10) Patent No.: US 11,261,579 B1
(45) Date of Patent: Mar. 1, 2022

(54) BUCKET MOUNTABLE PLOW

(71) Applicant: Homer Willis, Keithville, LA (US)

(72) Inventor: Homer Willis, Keithville, LA (US)

( * ) Notice: Subject to any disclaimer, the term of this patent is extended or adjusted under 35 U.S.C. 154(b) by 0 days.

(21) Appl. No.: 17/461,138

(22) Filed: Aug. 30, 2021

(51) Int. Cl.
*E02F 3/815* (2006.01)
*E01H 5/06* (2006.01)

(52) U.S. Cl.
CPC ..... *E02F 3/8152* (2013.01); *E01H 5/061* (2013.01)

(58) Field of Classification Search
CPC ..... E02F 3/8152; E02F 3/962; E01H 5/067; E01H 5/066; E01H 5/061; Y10S 293/06
See application file for complete search history.

(56) References Cited

U.S. PATENT DOCUMENTS 2,964,862 A * 12/1960 Lotz ..... E02F 3/8155 37/280
3,216,337 A * 11/1965 MacDonald ..... E01C 19/15 404/104
3,605,906 A 9/1971 Coates
3,864,793 A * 2/1975 Guest ..... E02F 3/966 24/569
4,049,060 A * 9/1977 Hoke ..... E02F 3/962 172/19
4,076,314 A * 2/1978 Dodich ..... E01C 23/092 172/778
4,077,139 A * 3/1978 Fagervold ..... E01H 5/067 172/784
4,145,825 A * 3/1979 Bertolino ..... E01H 5/065 172/113
4,201,000 A * 5/1980 Stanford ..... E02F 3/8152 37/407
4,328,628 A * 5/1982 Thomas ..... E01H 5/06 37/231
4,360,980 A * 11/1982 Jarvis ..... E02F 3/815 172/701.1
4,462,172 A 7/1984 Caron
4,741,116 A * 5/1988 Engle ..... E01H 5/065 172/701.1
4,962,600 A * 10/1990 Zellaha ..... E01H 5/065 172/815
5,215,150 A 6/1993 Wilkins
5,377,766 A * 1/1995 Klinger ..... E01C 19/15 172/382
5,596,825 A * 1/1997 Von Schalscha ..... E02F 3/8152 172/701.3
5,615,499 A * 4/1997 McGuire ..... E02D 17/06 37/367
5,775,013 A * 7/1998 Von Schalscha ..... E02F 3/962 172/701.3
5,943,798 A * 8/1999 McGuire ..... E02D 17/06 37/367

(Continued)

*Primary Examiner* — Jamie L McGowan
(74) *Attorney, Agent, or Firm* — R. Keith Harrison

(57) ABSTRACT

Bucket mountable plow suitable for mounting on a front bucket of a loader vehicle may include a clamp assembly configured for mounting on the front bucket of the loader vehicle. A plow blade mount assembly may be carried by the clamp assembly. The plow blade mount assembly may have a fore-aft axis configured to be oriented along a direction of travel of the loader vehicle. A plow blade may be carried by the plow blade mount assembly. The plow blade may be disposed at a blade angle with respect to the fore-aft axis.

18 Claims, 7 Drawing Sheets

(56) References Cited

U.S. PATENT DOCUMENTS

| | | | | |
|---|---|---|---|---|
| 6,022,184 | A * | 2/2000 | Friedland | B66F 9/12 37/405 |
| 6,085,447 | A * | 7/2000 | Rose | E02F 3/962 37/403 |
| 6,209,235 | B1 * | 4/2001 | Schiltz | E01H 5/02 37/265 |
| 6,298,585 | B1 * | 10/2001 | Boulet | E01H 5/066 172/817 |
| 6,315,056 | B1 * | 11/2001 | Ransom | E01H 1/105 172/246 |
| 6,363,631 | B1 * | 4/2002 | Cordingley | E01H 5/066 37/280 |
| 6,463,683 | B1 * | 10/2002 | Skwarchuk | E01H 5/066 37/274 |
| 9,163,379 | B2 | 10/2015 | Winter | |
| 9,416,520 | B2 * | 8/2016 | Sheehan | E02F 9/2883 |
| 9,469,975 | B2 * | 10/2016 | Sheehan | E02F 9/2883 |
| 9,562,342 | B2 | 2/2017 | Winter et al. | |
| 2003/0228210 | A1 * | 12/2003 | Friedland | B66F 9/12 414/724 |
| 2006/0288617 | A1 * | 12/2006 | Colclough | E01H 5/066 37/264 |
| 2014/0248111 | A1 * | 9/2014 | Williams | E02F 3/962 414/724 |
| 2014/0317968 | A1 * | 10/2014 | Payne | E02F 3/962 37/405 |
| 2015/0267377 | A1 * | 9/2015 | Whipple | E02F 3/962 37/266 |
| 2016/0289918 | A1 * | 10/2016 | Waldner | B66F 9/12 |
| 2017/0037597 | A1 * | 2/2017 | McLoughlin | E02F 3/962 |
| 2021/0198858 | A1 * | 7/2021 | Henning | E01H 5/066 |

* cited by examiner

BUCKET MOUNTABLE PLOW

FIELD

Illustrative embodiments of the disclosure generally relate to plows. More particularly, illustrative embodiments of the disclosure relate to a bucket mountable plow which can be mounted on the bucket of a loader vehicle to form a furrow or trench adjacent to the loader vehicle.

SUMMARY

Illustrative embodiments of the disclosure are generally directed to bucket mountable plow suitable for mounting on a front bucket of a loader vehicle. An illustrative embodiment of the bucket mountable plow may include a clamp assembly configured for mounting on the front bucket of the loader vehicle. A plow blade mount assembly may be carried by the clamp assembly. The plow blade mount assembly may have a fore-aft axis configured to be oriented along a direction of travel of the loader vehicle. A plow blade may be carried by the plow blade mount assembly. The plow blade may be disposed at a blade angle with respect to the fore-aft axis.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
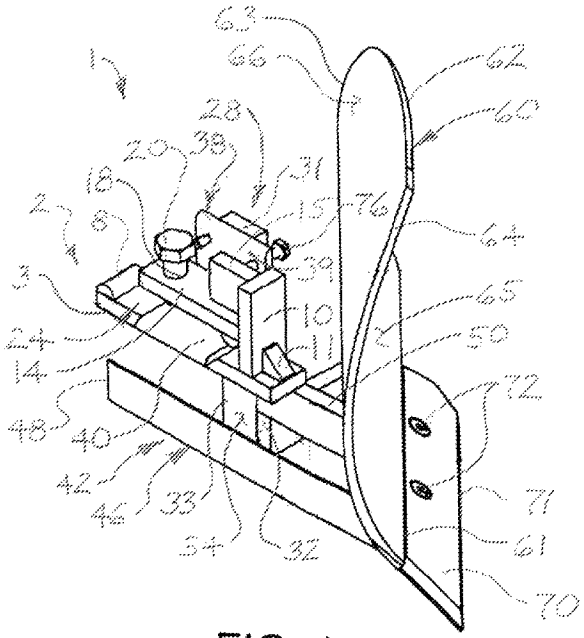
FIG. 1 is a right-side perspective view of an illustrative embodiment of the bucket mountable plow.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear" "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 9-13 of the drawings, an illustrative embodiment of the bucket mountable plow is generally indicated by reference numeral 1. As will be hereinafter further described, the bucket mountable plow 1 may be suitably configured to be mounted on a front bucket 94 of a loader vehicle 90. The loader vehicle 90 may have a conventional front-end loader design with a vehicle chassis 91 and vehicle wheels 92, or alternatively, a pair of left and right vehicle tracks (not illustrated). The front bucket 94 may extend forwardly from the vehicle chassis 91 on bucket mount arms (not illustrated). Hydraulic cylinders (not illustrated) may operably engage the bucket mount arms to raise and lower the front bucket 94, typically in the conventional manner.

Figure 10:
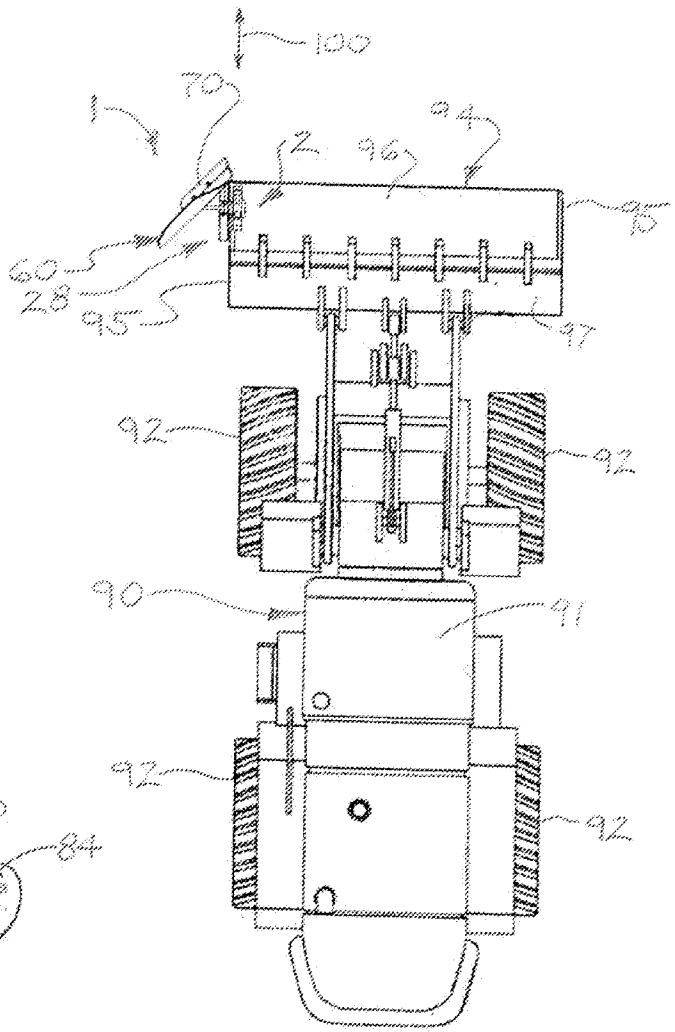
FIG. 10 is a top view of the loader vehicle with the bucket mountable plow mounted on the front bucket thereof.
Figure 9:
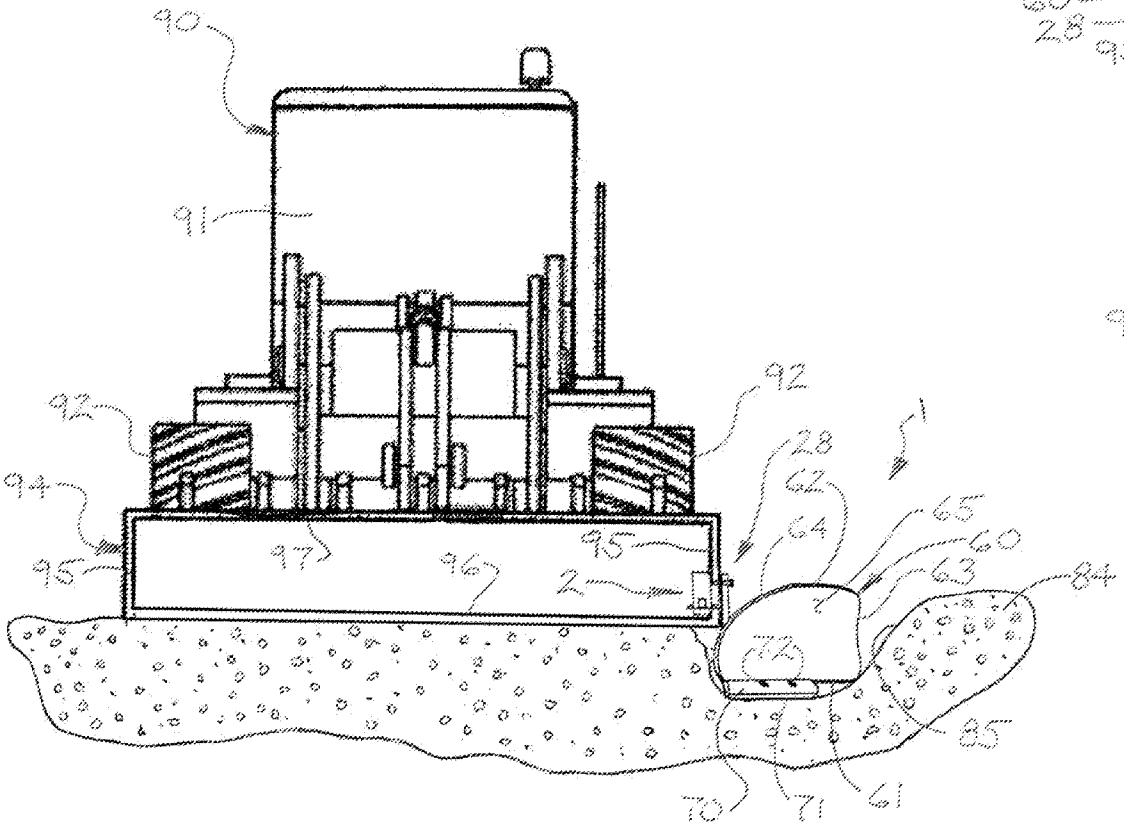
FIG. 9 is a front view of a typical loader vehicle with the illustrative bucket mountable plow mounted on a front bucket on the loader vehicle.

As illustrated in FIGS. 9 and 10, the front bucket 94 of the loader vehicle 90 may have a pair of spaced-apart bucket sidewalls 95. A bucket bottom wall 96 and a bucket top wall 97 may extend between the bucket sidewalls 95. In some embodiments, the bucket-mountable plow 1 may be configured to be mounted on one of the bucket sidewalls 95 of the front bucket 94, as illustrated. Accordingly, as illustrated in FIG. 9, as the loader vehicle 90 is operated in the forward direction on soil 84, the bucket mountable plow 1 may form a furrow or trench 85 in the soil 84 alongside the loader vehicle 90, typically as will be hereinafter further described.

Figure 2:
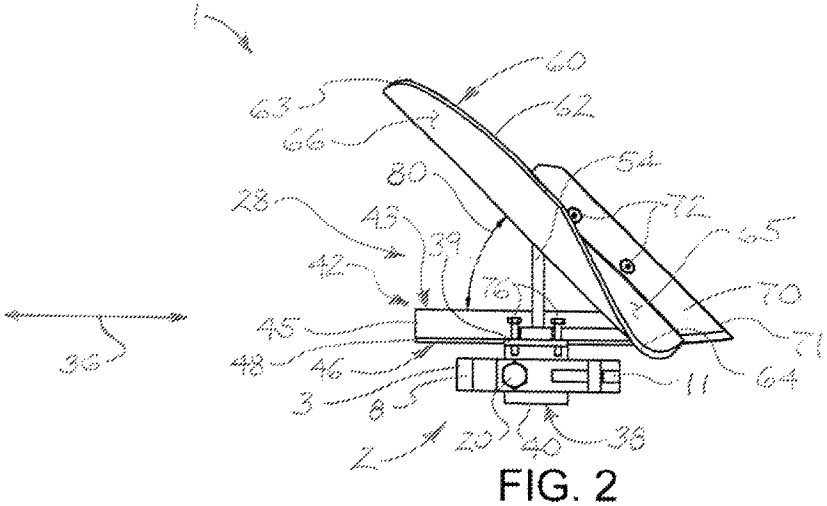
FIG. 2 is a top view of the illustrative bucket mountable plow.
Figure 3:
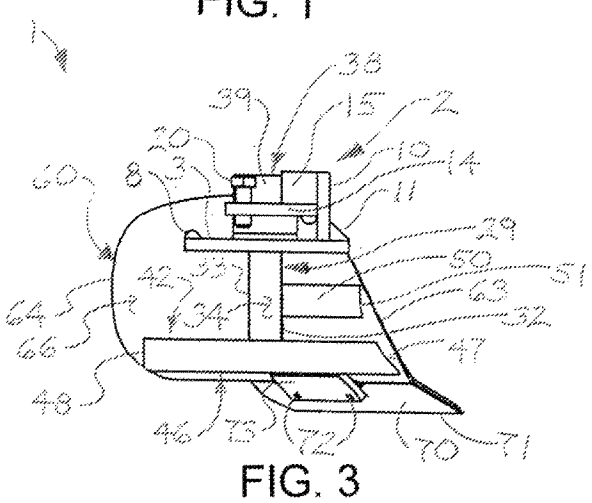
FIG. 3 is a right-side view of the illustrative bucket mountable plow.
Figure 4:
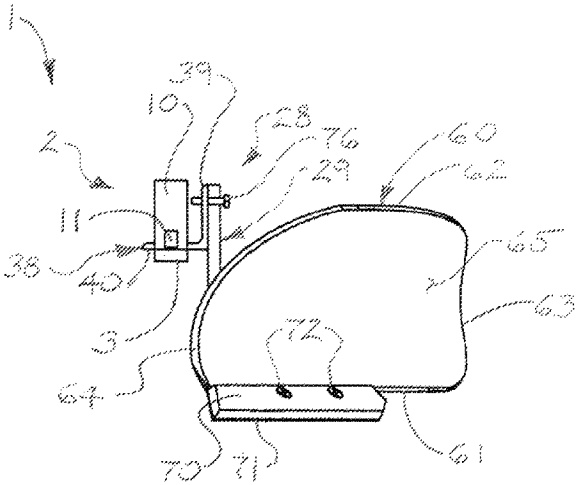
FIG. 4 is a front view of the illustrative bucket mountable plow.
Figure 5:
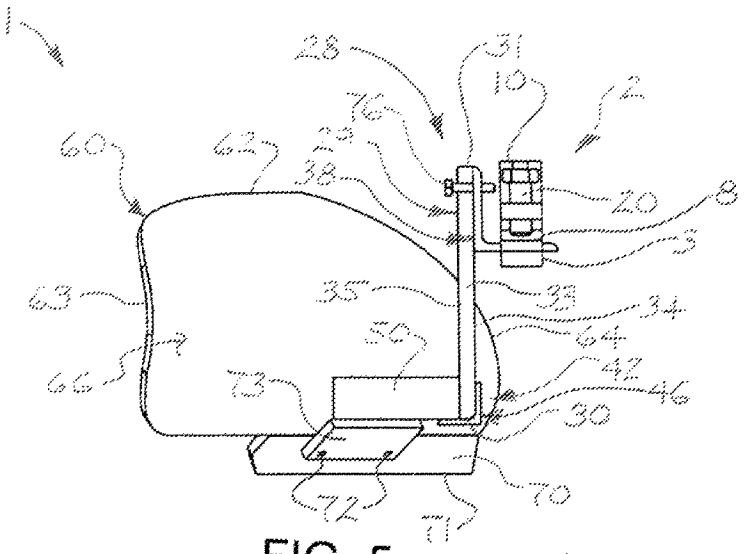
FIG. 5 is a rear view of the illustrative bucket mountable plow.

Referring next to FIGS. 1-8 of the drawings, the bucket mountable plow 1 may include a clamp assembly 2. The clamp assembly 2 may be configured for mounting on the front bucket 94 (FIG. 9) of the loader vehicle 90, typically as will be hereinafter described. A plow blade mount assembly 28 may be supported by the clamp assembly 2. As illustrated in FIG. 2, the plow blade mount assembly 28 may have a fore-aft axis 36. In typical application of the bucket mountable plow 1, the fore-aft axis 36 of the plow blade mount assembly 28 may be configured to be oriented along a direction of travel 100 (FIG. 10) of the loader vehicle 90, as will be hereinafter described.

Figure 6:
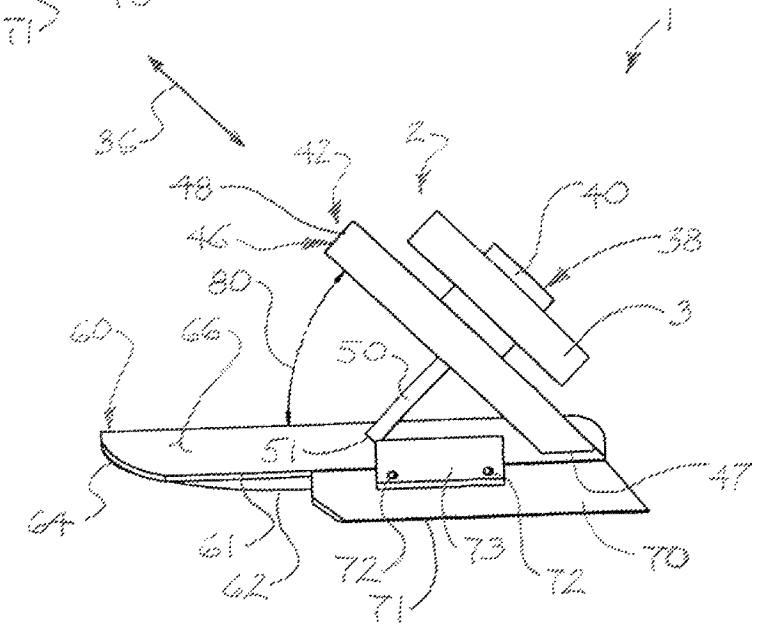
FIG. 6 is a bottom view of the illustrative bucket mountable plow.

A plow blade 60 may be supported by the plow blade mount assembly 28. As illustrated in FIGS. 2 and 6, the plow blade 60 may be disposed at a blade angle 80 with respect to the fore-aft axis 36. In some embodiments, the blade angle 80 may be 0 to 90 degrees. For example and without limitation, in some embodiments, the blade angle 80 may be 45 degrees.

The clamp assembly 2 may have any design, structure, component or components which facilitate secure attachment of the plow blade mount assembly 28 to the front bucket 94 of the loader vehicle 90. As particularly illustrated in FIGS. 7 and 8, in some embodiments, the clamp assembly 2 may include a bottom clamp member 3. A clamp member support 10 may extend from the bottom clamp member 3 typically in perpendicular relationship thereto. A top clamp member 14 may extend from the clamp member support 10. The top clamp member 14 may be disposed in parallel and spaced-apart relationship to the bottom clamp member 3 and in perpendicular relationship to the clamp member support 10. In some embodiments, at least one bottom gusset 11 may reinforce the clamp member support 10 with respect to the bottom clamp member 3. At least one top gusset 15 may reinforce the top clamp member 14 with respect to the clamp member support 10.

Figure 7:
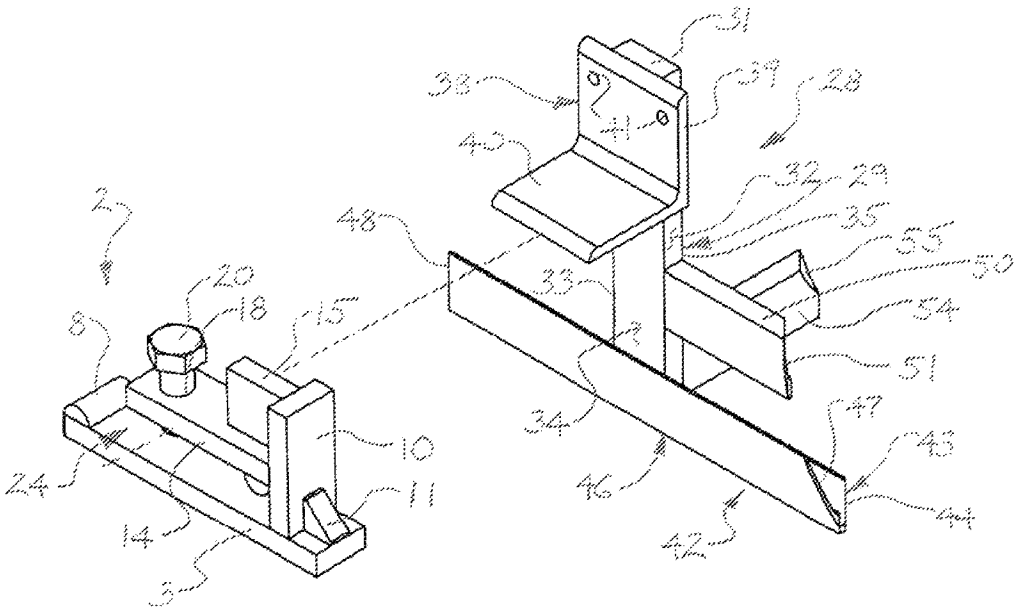
FIG. 7 is an exploded perspective view illustrating typical attachment of a clamp assembly to a plow blade mount assembly of the illustrative bucket mountable plow.

As illustrated in FIG. 7, a clamp space 24 may be formed by between the bottom clamp member 3 and the top clamp member 14. The clamp space 24 may be suitably sized and configured to receive the bucket bottom wall 96 (FIG. 9) of the front bucket 94 on the loader vehicle 90 in typical deployment of the clamp assembly 2 on the front bucket 94, typically as will be hereinafter described. In some embodiments, a bracket guide 8 may be provided on the bottom clamp member 3 adjacent to the clamp space 24, typically for purposes which will be hereinafter described.

In some embodiments, at least one clamp bolt opening 18 may extend through the top clamp member 14 of the clamp assembly 2. A clamp bolt 20 may be threaded in the clamp bolt opening 18. The clamp bolt 20 may extend into the clamp space 24. By rotation in the clamp bolt opening 18, the clamp bolt 20 may be positionally adjustable in the clamp space 24 typically for purposes which will be hereinafter described.

Figure 8:
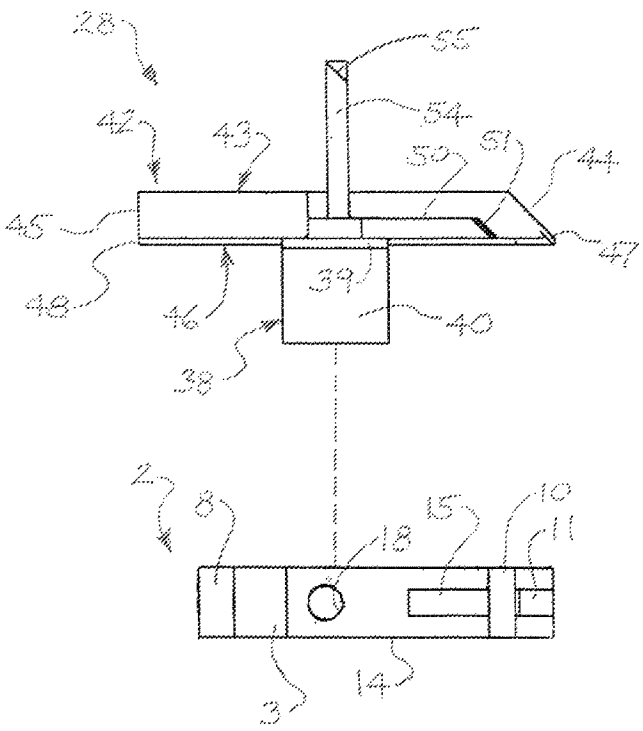
FIG. 8 is an exploded top view of the clamp assembly and the plow blade mount assembly illustrated in FIG. 7.

As illustrated in FIGS. 7 and 8, in some embodiments, the plow blade mount assembly 28 may include a blade mount assembly frame 29. The blade mount assembly frame 29 may be supported by the clamp assembly 2 typically in a manner which will be hereinafter described. In some embodiments, the blade mount assembly frame 29 may have a lower frame end 30 (FIG. 5) and an upper frame end 31. The blade mount assembly frame 29 may further include a typically flat or planar front frame surface 32, rear frame surface 33, inner frame surface 34 and outer frame surface 35.

An elongated main blade mount member 42 may be supported by the blade mount assembly frame 29, typically at the lower frame end 30 thereof. The main blade mount member 42 may be oriented along the fore-aft axis 36 of the plow blade mount assembly 28. The plow blade 60 may be supported by the main blade mount member 42, typically as will be hereinafter further described.

In some embodiments, the main blade mount member 42 of the plow blade mount assembly 28 may include an elongated lower mount member segment 43. An elongated side mount member segment 46 may extend from and along the lower mount member segment 43. The side mount member segment 46 may be disposed in perpendicular relationship to the lower mount member segment 43. Accordingly, the lower mount member segment 43 may lie flat against the lower frame end 30, whereas the side mount member segment 46 may lie flat against the inner frame surface 34 of the blade mount assembly frame 29.

The lower mount member segment 43 of the main blade mount member 42 may have a front lower segment end 44 and a rear lower segment end 45. Likewise, the side mount member segment 46 may have a front side segment end 47 and a rear side segment end 48. In some embodiments, the front lower segment end 44 of the lower mount member segment 43 and the front side segment end 47 of the side mount member segment 46 may be beveled or tapered to engage and conform to the shape or contour of the plow blade 60.

In some embodiments, a front blade mount member 50 may extend from the blade mount assembly frame 29 typically in spaced-apart, parallel relationship to the main blade mount member 42. The front blade mount member 50 may extend forwardly from the front frame surface 32 of the blade mount assembly frame 29. Accordingly, the plow blade 60 may be further supported by the front blade mount member 50. In some embodiments, the distal or extending end 51 of the front blade mount member 50 may be beveled or tapered to engage and conform to the shape or contour of the plow blade 60.

In some embodiments, an outer blade mount member 54 may extend from the blade mount assembly frame 29 typically in perpendicular relationship to the main blade mount member 42. The outer blade mount member 54 may extend outwardly from the outer frame surface 35 of the blade mount assembly frame 29. Accordingly, the plow blade 60 may be further supported by the outer blade mount member 54. In some embodiments, the distal or extending end 55 of the outer blade mount member 54 may be beveled or tapered to engage and conform to the shape or contour of the plow blade 60.

In some embodiments, a clamp assembly mount bracket 38 may be provided on the blade mount assembly frame 29 of the plow blade mount assembly 28, typically between the lower frame end 30 and the upper frame end 31 thereof. The clamp assembly mount bracket 38 may mount the plow blade mount assembly 28 to clamp assembly 2. The clamp assembly mount bracket 38 may include a rear bracket member 39. The rear bracket member 39 may be attached to the blade mount assembly frame 29 according to the knowledge of those skilled in the art. A bottom bracket member 40 may extend from and typically in perpendicular relationship to the rear bracket member 39. As illustrated in FIG. 1, in mounting the plow blade mount assembly 28 on the clamp assembly 2, the bottom bracket member 40 of the clamp assembly mount bracket 38 may extend through the clamp space 24 between the bottom clamp member 3 and the top clamp member 14 of the clamp assembly 2. The bottom bracket member 40 may be attached to the bottom clamp member 3 via welding, fasteners and/or other attachment technique known by those skilled in the art.

In some embodiments, the clamp assembly mount bracket 38 may be mounted for selective vertical adjustment along the length of the blade mount assembly frame 29 according to the knowledge of those skilled in the art. For example and without limitation, as illustrated in FIGS. 1 and 2, in some embodiments, a pair of bracket adjustment fasteners 76 may extend through a pair of respective bracket fastener openings 41 (FIG. 7) in the rear bracket member 39 of the clamp assembly mount bracket 38. The bracket adjustment fasteners 76 may mount the clamp assembly mount bracket 38 to the blade mount assembly frame 29. The bracket adjustment fasteners 76 may be selectively loosened to slide the clamp assembly mount bracket 38 along the blade mount assembly frame 29 and selectively tightened to secure the clamp assembly mount bracket 38 at the desired position.

As illustrated in FIGS. 1-6, the plow blade 60 may include a concave front blade surface 65 and a convex rear blade surface 66. A lower blade edge 61, an upper blade edge 62, an outer blade edge 63 and an inner blade edge 64 may circumscribe the front blade surface 65 and the rear blade surface 66. The lower blade edge 61 may be longer than the upper blade edge 62. The outer blade edge 63 may extend in a substantially straight course from the lower blade edge 61 to the upper blade edge 62. The inner blade edge 64 may extend in a curved trajectory from the lower blade edge 61 to the upper blade edge 62.

The plow blade 60 may be mounted on the plow blade mount assembly 28 according to the knowledge of those skilled in the art. In some embodiments, the front lower segment end 44 and the front side segment end 47 of the main blade mount member 42, the distal or extending end 51 of the front blade mount member 50 and the distal or extending end 55 of the outer blade mount member 54 may be welded to the rear blade surface 66 of the plow blade 60. In some embodiments, bolts, brackets and/or other mechanical fasteners suitable for the purpose may be used.

As further illustrated in FIGS. 1-6, in some embodiments, at least one blade extension 70 may be attached to the plow blade 60. The blade extension 70 may have a blade extension edge 71. In some embodiments, the blade extension 70 may extend along the lower blade edge 61 of the plow blade 60.

The blade extension 70 may be attached to the plow blade 60 using any suitable technique known by those skilled in the art. In some embodiments, at least one blade extension fastener 72 and at least one blade mount block 73 (FIG. 3) may attach the blade extension 70 to the plow blade 60. In typical application of the bucket mountable plow 1, which will be hereinafter described, the blade extension 70 may facilitate formation of a deeper trench 85 (FIG. 9) in the soil 84 adjacent to the loader vehicle 90 than could be achieved by using the plow blade 60 without the blade extension 70.

Referring next to FIGS. 9-13 of the drawings, in typical application, the bucket mountable plow 1 may be mounted on the front bucket 94 of the loader vehicle 90. As illustrated in FIG. 9, the plow blade 60 of the bucket mountable plow 1 may extend to the side of the front bucket 94 to form a trench 85 in the soil 84 adjacent to the loader vehicle 90 as the loader vehicle 90 is operated in the forward direction.

Figure 11:
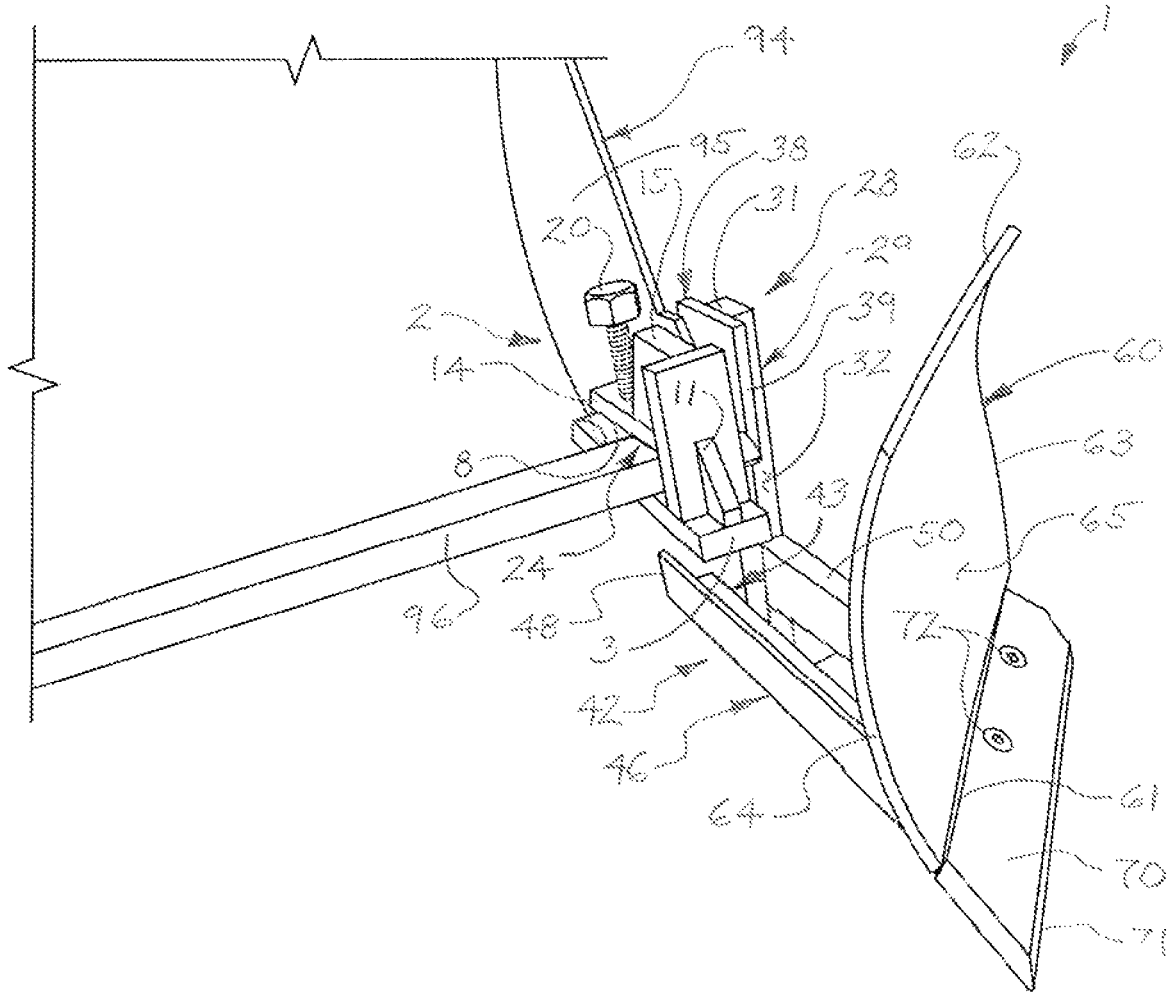
FIG. 11 is a right-side perspective view of the illustrative bucket mountable plow mounted on the front bucket (shown in section) of the loader vehicle.
Figure 12:
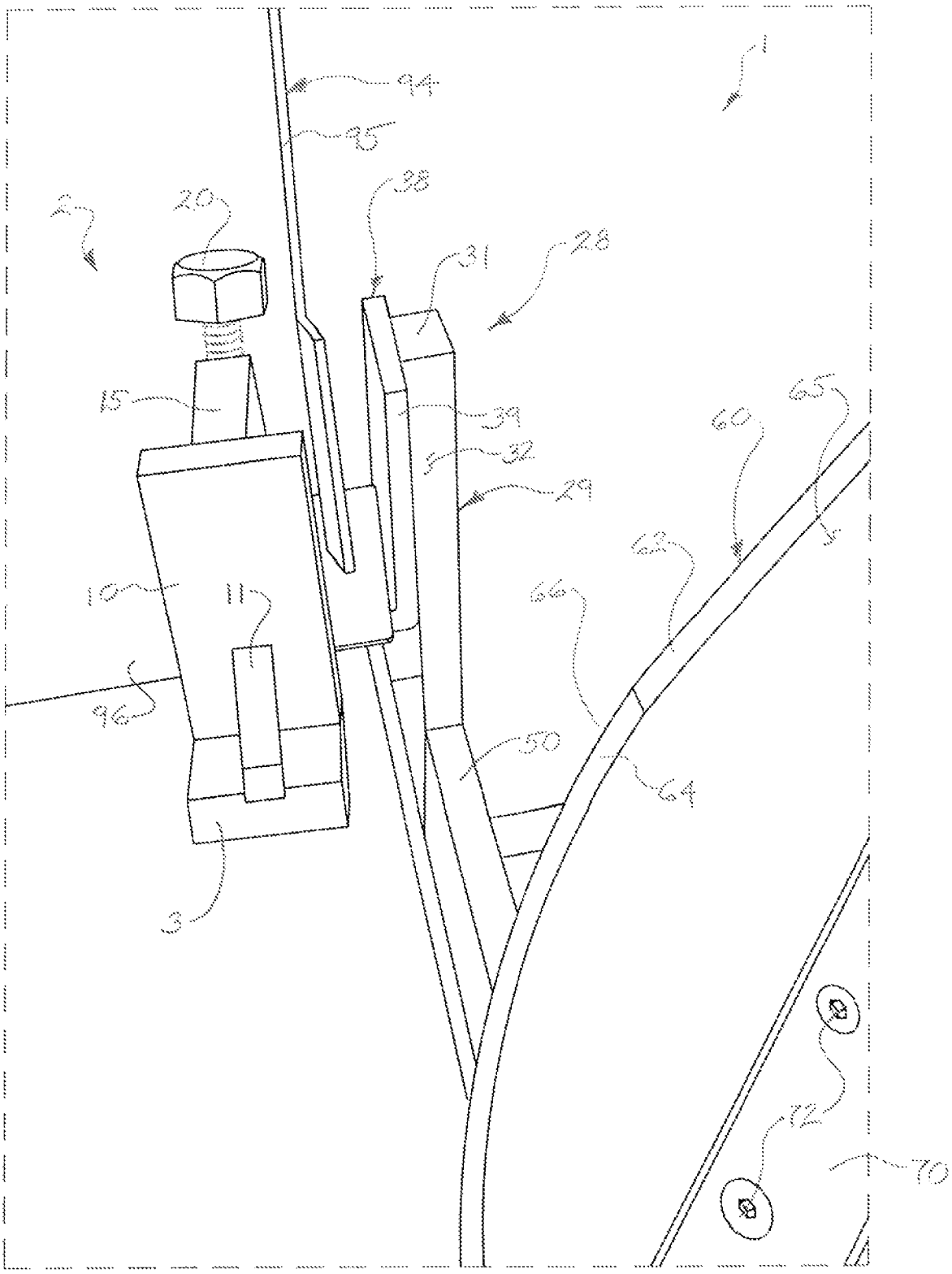
FIG. 12 is a front perspective view, partially in section, of the illustrative bucket mountable plow mounted on the front bucket (shown in section) of the loader vehicle.
Figure 13:
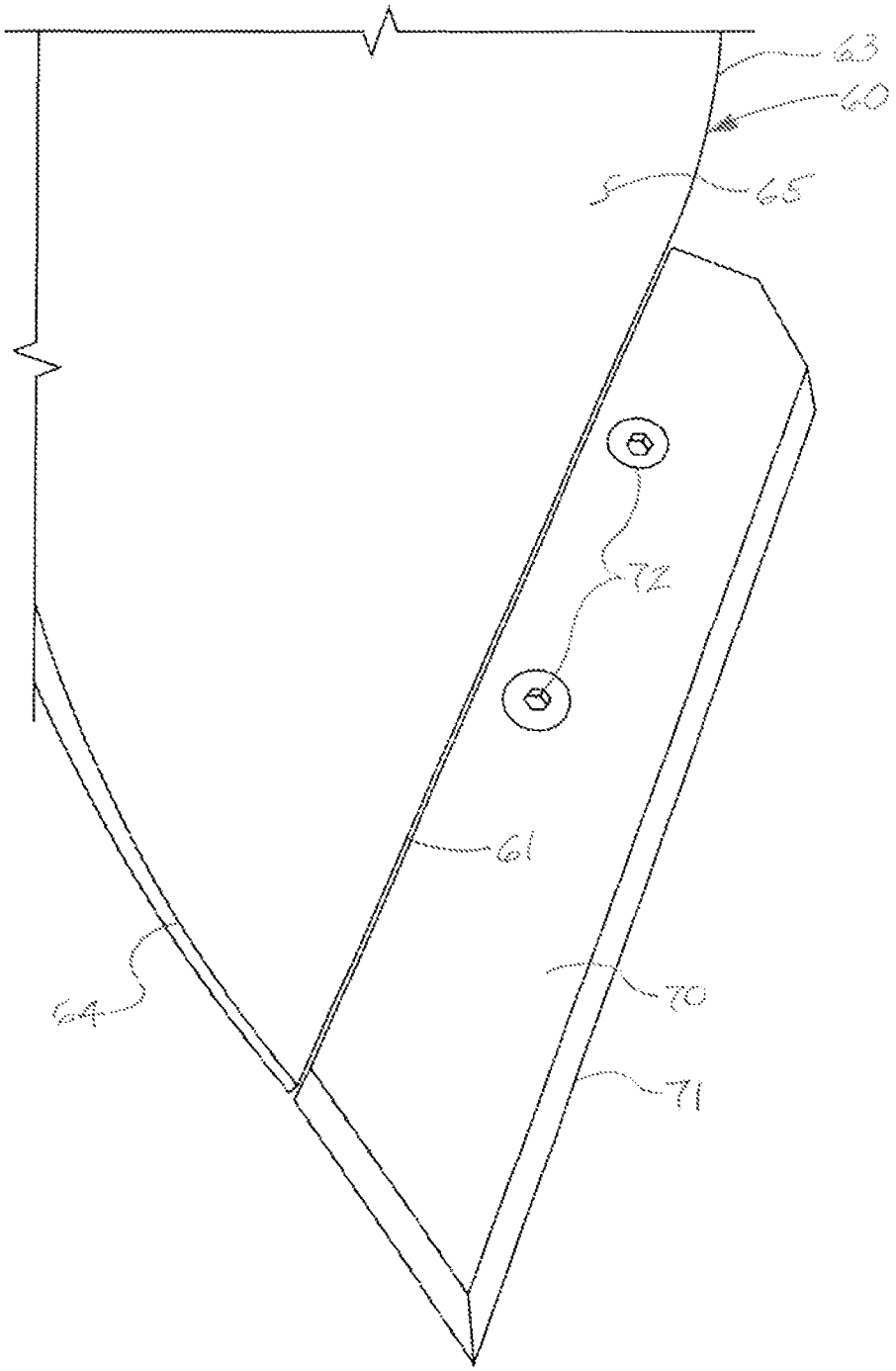
FIG. 13 is a perspective view of a typical blade extension mounted along the lower blade edge of the plow blade of the illustrative bucket mountable plow.

In typical application, the bucket mountable plow 1 may be mounted to the front bucket 94 on the loader vehicle 90 to form a trench 85 (FIG. 9) alongside the loader vehicle 90. The trench 85 may be used for planting, irrigation and/or other purposes. In some applications, the bucket mountable plow 1 may be attached to the front bucket 94 at a bottom corner between the bucket bottom wall 96 and a corresponding one of the bucket sidewalls 95 of the front bucket 94. Accordingly, as illustrated in FIGS. 11 and 12, the bucket sidewall 95 may insert between the top clamp member 14 of the clamp assembly 2 and the rear bracket member 39 of the clamp assembly mount bracket 38 on the blade mount assembly frame 29 of the plow blade mount assembly 28, with the bucket bottom wall 96 extending through the clamp space 24 between the bottom clamp member 3 and the top clamp member 14 of the clamp assembly 2. The clamp bolt 20 on the clamp assembly 2 may be tightened against the bucket bottom wall 96 of the front bucket 94 to secure the clamp assembly 2 and the attached plow blade mount assembly 28 and plow blade 60 on the front bucket 94. Accordingly, as illustrated in FIG. 10, the plow blade 60 may be oriented outwardly at an obtuse angle with respect to the direction of travel 100 of the loader vehicle 90.

In some applications, the height of the plow blade 60 on the plow blade mount assembly 28 may be selectively adjusted typically by manipulation of the bracket adjustment fasteners 76 (FIGS. 1 and 2). In typical application, the height of the plow blade 60 on the front bucket 94 may be selected such that the blade extension 70 on the plow blade 60 extends beneath the plane of the bucket bottom wall 96 of the front bucket 94, as illustrated in FIG. 9.

As further illustrated in FIG. 9, the loader vehicle 90 may be operated in the forward direction on the soil 84 in which the plow blade 60 is to cut the trench 85. Accordingly, the plow blade 60 forms the trench 85 in the soil 84 as the trench 84 extends adjacent to or alongside the loader vehicle 90 and adjacent to the direction of travel 10) (FIG. 10) of the loader vehicle 90.

After use, the bucket mountable plow 1 may be detached from the front bucket 94 of the loader vehicle 90 typically by loosening the clamp bolt 20 and removing the clamp assembly 2 from the bucket sidewall 95 and bucket bottom wall 96 of the front bucket 94.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A bucket mountable plow suitable for mounting on a front bucket of a loader vehicle, the bucket mountable plow comprising:

a clamp assembly configured for mounting on the front bucket of the loader vehicle;

a plow blade mount assembly having a blade mount assembly frame carried by the clamp assembly and an elongated main blade mount member carried by the blade mount assembly frame, the main blade mount member of the plow blade mount assembly having a fore-aft axis configured to be oriented along a direction of travel of the loader vehicle;

a clamp assembly mount bracket carried by and vertically adjustable with respect to the blade mount assembly frame of the plow blade mount assembly, the clamp assembly carried by the clamp assembly mount bracket; and a plow blade carried by the plow blade mount assembly, the plow blade disposed at a blade angle with respect to the fore-aft axis.

2. The bucket mountable plow of claim 1 further comprising a front blade mount member extending from the blade mount assembly frame in spaced-apart, parallel relationship to the main blade mount member, and wherein the plow blade is further carried by the front blade mount member.

3. The bucket mountable plow of claim 1 further comprising an outer blade mount member extending from the blade mount assembly frame in perpendicular relationship to the main blade mount member, and wherein the plow blade is further carried by the outer blade mount member.

4. The bucket mountable plow of claim 1 wherein the main blade mount member comprises a first mount member segment and a second mount member segment extending from the first mount member segment in perpendicular relationship to the first mount member segment.

5. The bucket mountable plow of claim 1 wherein the plow blade comprises a concave front blade surface and a lower blade edge, an upper blade edge, an outer blade edge and an inner blade edge circumscribing the front blade surface.

6. The bucket mountable plow of claim 5 further comprising at least one blade extension extending from the lower blade edge of the plow blade.

7. A bucket mountable plow suitable for mounting on a front bucket of a loader vehicle, the front bucket having a pair of spaced-apart bucket sidewalls and a bucket bottom wall extending between the bucket sidewalls, the bucket mountable plow comprising:

a clamp assembly including:

a first clamp member;

a second clamp member carried by and disposed in spaced-apart relationship to the first clamp member; and a clamp space between the first clamp member and the second clamp member, the clamp space configured to receive the bucket bottom wall of the front bucket of the loader vehicle in deployment of the clamp assembly on the front bucket;

a plow blade mount assembly carried by the second clamp member of the clamp assembly, the plow blade mount assembly having a fore-aft axis configured to be oriented along a direction of travel of the loader vehicle in deployment of the clamp assembly on the front bucket, the clamp assembly vertically adjustable with respect to the plow blade mount assembly; and a plow blade carried by the plow blade mount assembly, the plow blade disposed at a blade angle with respect to the fore-aft axis.

8. The bucket mountable plow of claim 7 wherein the plow blade mount assembly comprises a blade mount assembly frame carried by the clamp assembly and an elongated main blade mount member carried by the blade mount assembly frame and oriented along the fore-aft axis, and wherein the plow blade is carried by the main blade mount member.

9. The bucket mountable plow of claim 8 further comprising a front blade mount member extending from the blade mount assembly frame in spaced-apart, parallel relationship to the main blade mount member, and wherein the plow blade is further carried by the front blade mount member.

10. The bucket mountable plow of claim 8 further comprising an outer blade mount member extending from the blade mount assembly frame in perpendicular relationship to the main blade mount member, and wherein the plow blade is further carried by the outer blade mount member.

11. The bucket mountable plow of claim 8 further comprising a clamp assembly mount bracket carried by the blade mount assembly frame, and wherein the clamp assembly is carried by the clamp assembly mount bracket.

12. The bucket mountable plow of claim 8 wherein the main blade mount member comprises a first mount member segment and a second mount member segment extending from the first mount member segment in perpendicular relationship to the first mount member segment.

13. The bucket mountable plow of claim 7 wherein the plow blade comprises a concave front blade surface and a lower blade edge, an upper blade edge, an outer blade edge and an inner blade edge circumscribing the front blade surface.

14. The bucket mountable plow of claim 13 further comprising at least one blade extension extending from the lower blade edge of the plow blade.

15. A bucket mountable plow suitable for mounting on a front bucket of a loader vehicle, the front bucket having a pair of spaced-apart bucket sidewalls and a bucket bottom wall extending between the bucket sidewalls, the bucket mountable plow comprising:

a clamp assembly including:

a first clamp member;

a clamp member support extending from the first clamp member in perpendicular relationship thereto;

a second clamp member carried by the clamp member support and disposed in parallel and spaced-apart relationship to the first clamp member; and a clamp space between the first clamp member and the second clamp member, the clamp space configured to receive the bucket bottom wall of the front bucket of the loader vehicle in deployment of the clamp assembly on the front bucket;

a plow blade mount assembly including:

an elongated blade mount assembly frame carried by the clamp assembly, the blade mount assembly frame having a first frame end and a second frame end;

a clamp assembly mount bracket carried by the blade mount assembly frame at the second frame end, the clamp assembly mount bracket carried by the second clamp member of the clamp assembly;

an elongated main blade mount member carried by the blade mount assembly frame at the first frame end, the main blade mount member oriented along a fore-aft axis configured to be oriented along a direction of travel of the loader vehicle in deployment of the clamp assembly with the front bucket, the main blade mount member perpendicular to the blade mount assembly frame;

a front blade mount member extending from the blade mount assembly frame in spaced-apart, parallel relationship to the main blade mount member;

an outer blade mount member extending from the blade mount assembly frame in perpendicular relationship to the main blade mount member; and a plow blade carried by the main blade mount member, the front blade mount member and the outer blade mount member of the plow blade mount assembly, the plow blade disposed at a blade angle with respect to the fore-aft axis.

16. The bucket mountable plow of claim 15 wherein the main blade mount member comprises a first mount member segment and a second mount member segment extending from the first mount member segment in perpendicular relationship to the first mount member segment.

17. The bucket mountable plow of claim 15 wherein the plow blade comprises a concave front blade surface and a lower blade edge, an upper blade edge, an outer blade edge and an inner blade edge circumscribing the front blade surface.

18. The bucket mountable plow of claim 15 further comprising at least one blade extension extending from the lower blade edge of the plow blade.

* * * * *